US007871019B1

(12) United States Patent
Hou

(10) Patent No.: US 7,871,019 B1
(45) Date of Patent: Jan. 18, 2011

(54) PRESSURE-ADJUSTABLE JET SPRAY NOZZLE FOR CLEANING MACHINE

(75) Inventor: James S. T. Hou, Hong Kong (CN)

(73) Assignee: Active Products International Limited, Hong Kong (CN)

( * ) Notice: Subject to any disclaimer, the term of this patent is extended or adjusted under 35 U.S.C. 154(b) by 43 days.

(21) Appl. No.: 12/495,822

(22) Filed: Jul. 1, 2009

(51) Int. Cl.
*B05B 9/01* (2006.01)
*B05B 1/16* (2006.01)
*B05B 1/12* (2006.01)
*B05B 1/00* (2006.01)

(52) U.S. Cl. ..... 239/443; 239/447; 239/448; 239/525; 239/600

(58) Field of Classification Search ..... 239/390, 239/396, 436, 443–449, 525, 530, 600
See application file for complete search history.

(56) References Cited

U.S. PATENT DOCUMENTS 4,886,213 A * 12/1989 Kristensen ..... 239/458
5,242,116 A * 9/1993 Bonezzi ..... 239/438
6,016,975 A * 1/2000 Amaduzzi ..... 239/447
6,758,413 B1 * 7/2004 Chen ..... 239/525
2005/0263623 A1 * 12/2005 Hofer ..... 239/589

* cited by examiner

*Primary Examiner*—Darren W Gorman
(74) *Attorney, Agent, or Firm*—Pai Patent & Trademark Law Firm; Chao-Chang David Pai

(57) ABSTRACT

An adjustable jet gun for cleaning machine includes a barrel, a pressure adjustment sleeve fastened to the front end of the barrel and operable to adjust the pressure of water delivered through the adjustable jet gun, a support ring sleeved onto the front end of the pressure adjustment sleeve and holding a steel ball in each of a number of ball racks around the periphery thereof, a sliding sleeve sleeved onto the support ring and movable to force the steel balls out of the inside wall of the support ring, a nozzle head detachably connected to the front end of the support ring and having a positioning groove extending around the periphery of a rear positioning ring thereof for receiving the steel balls to lock the nozzle head to the support ring.

7 Claims, 10 Drawing Sheets

PRESSURE-ADJUSTABLE JET SPRAY NOZZLE FOR CLEANING MACHINE

BACKGROUND OF THE INVENTION (a) Field of the Invention

The present invention relates to a jet spray nozzle for cleaning machine and more particularly to a pressure-adjustable jet spray nozzle, which allows adjustment of the pressure of the jet spray water or cleaning fluid during operation and also allows replacement of the nozzle head.

(b) Description of the Prior Art

Conventional high-pressure cleaning machines commonly use a motor or engine to drive a pump in pumping compressed clean water or cleaning fluid to a water pipe that has a jet spray nozzle at the free end. A user can control a control level of the jet spray nozzle to let compressed clean water or cleaning fluid be driven out of the nozzle tip of the jet spray nozzle for cleaning. However, a conventional jet spray nozzle, for example, the ejection nozzle for high-pressure and lower-pressure cleaning apparatus as disclosed in U.S. Pat. No. 5,242,116, simply allows adjustment of the pressure of output water or cleaning fluid. It does not allow replacement of the nozzle head by the user. There is known a jet spray nozzle that allows replacement of the nozzle head. However, this design of jet spray nozzle is for use to spray gasoline. The nozzle head and other component parts of this design of jet spray nozzle are made of metal. Thus, the manufacturing cost of this design of jet spray nozzle is relatively high. Because of the relatively high cost, this design of jet spray nozzle is not suitable for use with a high-pressure cleaning apparatus for ejecting clean water or cleaning fluid for cleaning.

Therefore, there is a strong need for an inexpensive jet spray nozzle that allows replacement of the nozzle head.

SUMMARY OF THE INVENTION

The present invention has been accomplished under the circumstances in view. It is an object of the present invention to provide a pressure-adjustable jet spray nozzle, which has the nozzle head and other component parts thereof made by means of a combination of metal and plastics to lower the cost and to facilitate replacement of the nozzle head. It is another object of the present invention to provide a pressure-adjustable jet spray nozzle, which allows rotation of the nozzle head to adjust the pressure of jet spray of water or cleaning fluid during operation.

To achieve these and other objects of the present invention, a pressure-adjustable jet spray nozzle is disclosed to include a barrel, a pressure adjuster, a support device, a nozzle head lock control device, and a nozzle head.

The barrel defines a flow passage through front and rear ends thereof. The pressure adjuster comprises an adjustment sleeve sleeved onto the barrel, and a front ring affixed to the front end of the adjustment sleeve. The adjustment sleeve has a locating groove extending around the periphery near the front end thereof. The front ring defines a center through hole. The support device comprises a support ring sleeved onto the front end of the adjustment sleeve, a plurality of ball racks fixedly mounted in the support ring and equiangularly spaced around the periphery of the support ring, each ball rack having a ball hole, a connection ring surrounding the locating groove of the adjustment sleeve and having at least one mounting through hole, an elastic member mounted in the locating groove of the adjustment sleeve, at least one stop block respectively mounted in the at least one mounting through hole of the connection ring and having a bottom side thereof kept in contact with the elastic member which imparts an outward pressure to the at least one stop block, a plurality of steel balls respectively rotatably mounted in the ball holes of the ball racks, and a stop ring fastened to the front end of the support ring. The nozzle head lock control device comprises a sliding sleeve sleeved onto the support ring and axially movable between the at least one stop block and the stop ring for forcing the steel balls out of the inside wall of the support ring, and a compression spring sleeved onto the support ring within the sliding sleeve and adapted to impart a forward pressure to the sliding sleeve relative to the support ring. The nozzle head is insertable into the support ring, having a positioning ring fastened to the periphery thereof. The positioning ring has a positioning groove extending around the periphery for receiving the steel balls to let the nozzle head be locked to the support ring.

DETAILED DESCRIPTION OF THE PREFERRED EMBODIMENTS

Figure 1:
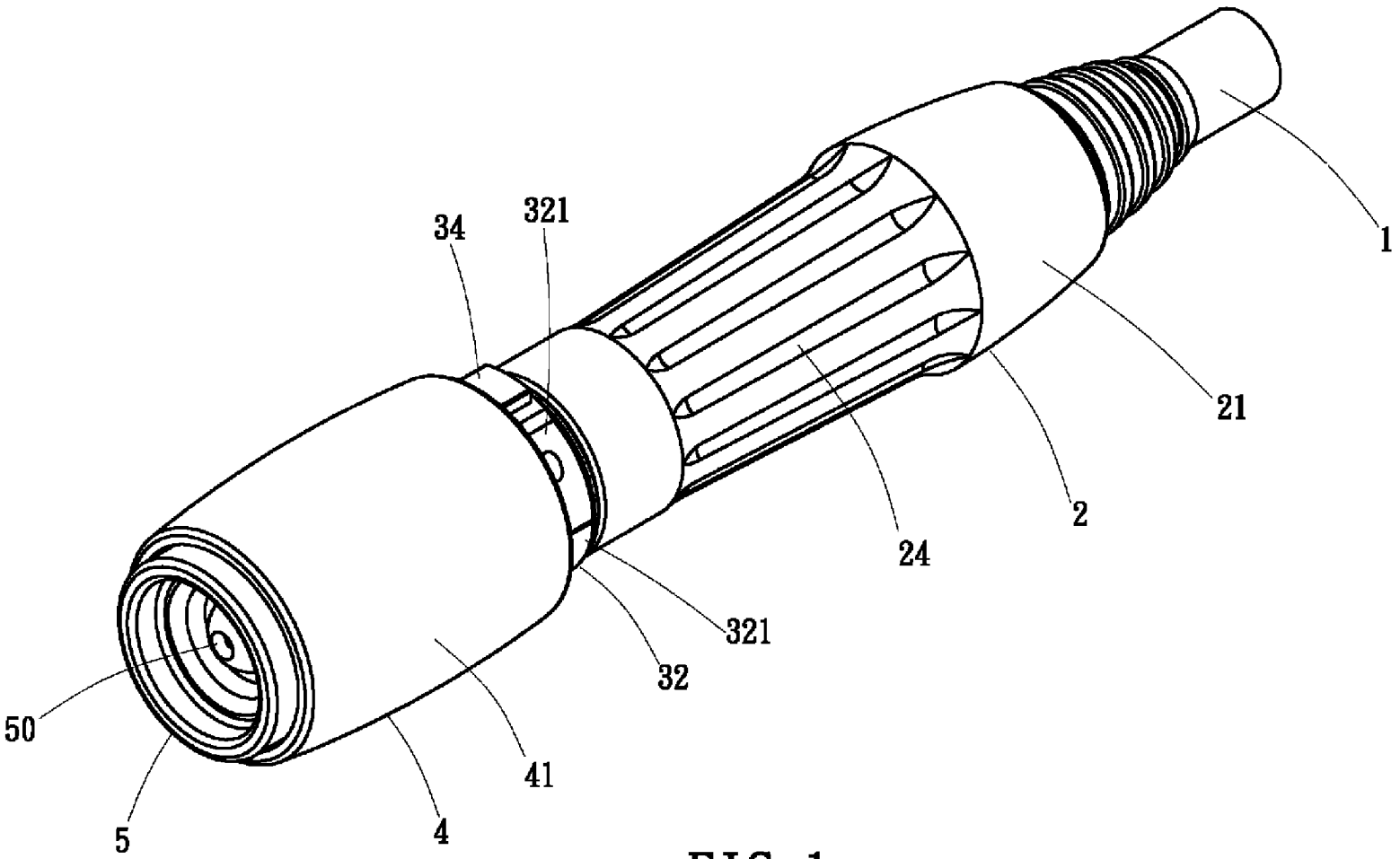
FIG. 1 is a perspective view of a pressure-adjustable jet spray nozzle in accordance with the present invention.

As shown in FIG. 1, a pressure-adjustable jet spray nozzle in accordance with the present invention comprises a barrel 1, a pressure adjuster 2, a support device 3, a nozzle head lock control device 4 and a nozzle head 5.

Figure 2:
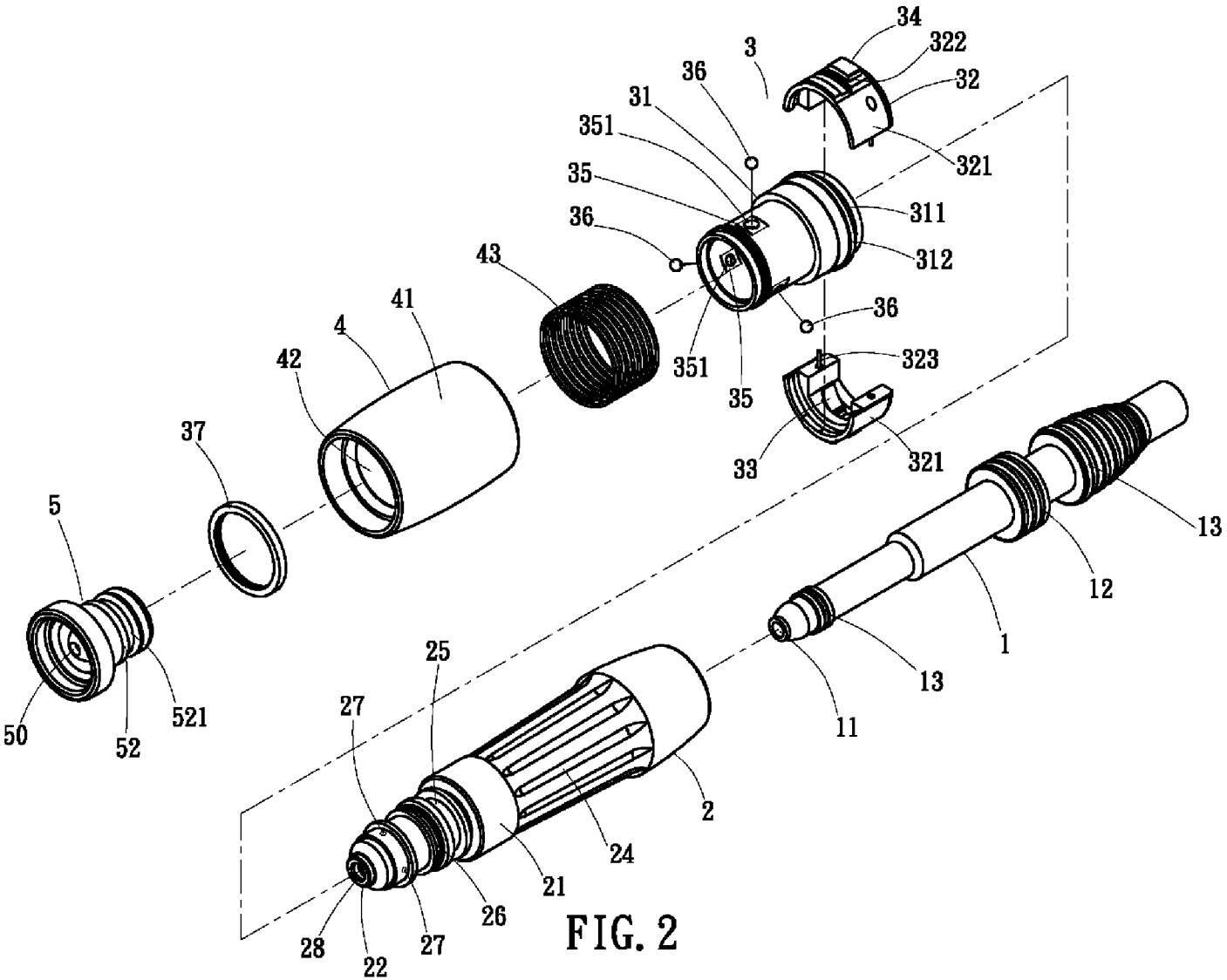
FIG. 2 is an exploded view of the pressure-adjustable jet spray nozzle in accordance with the present invention.
Figure 3:
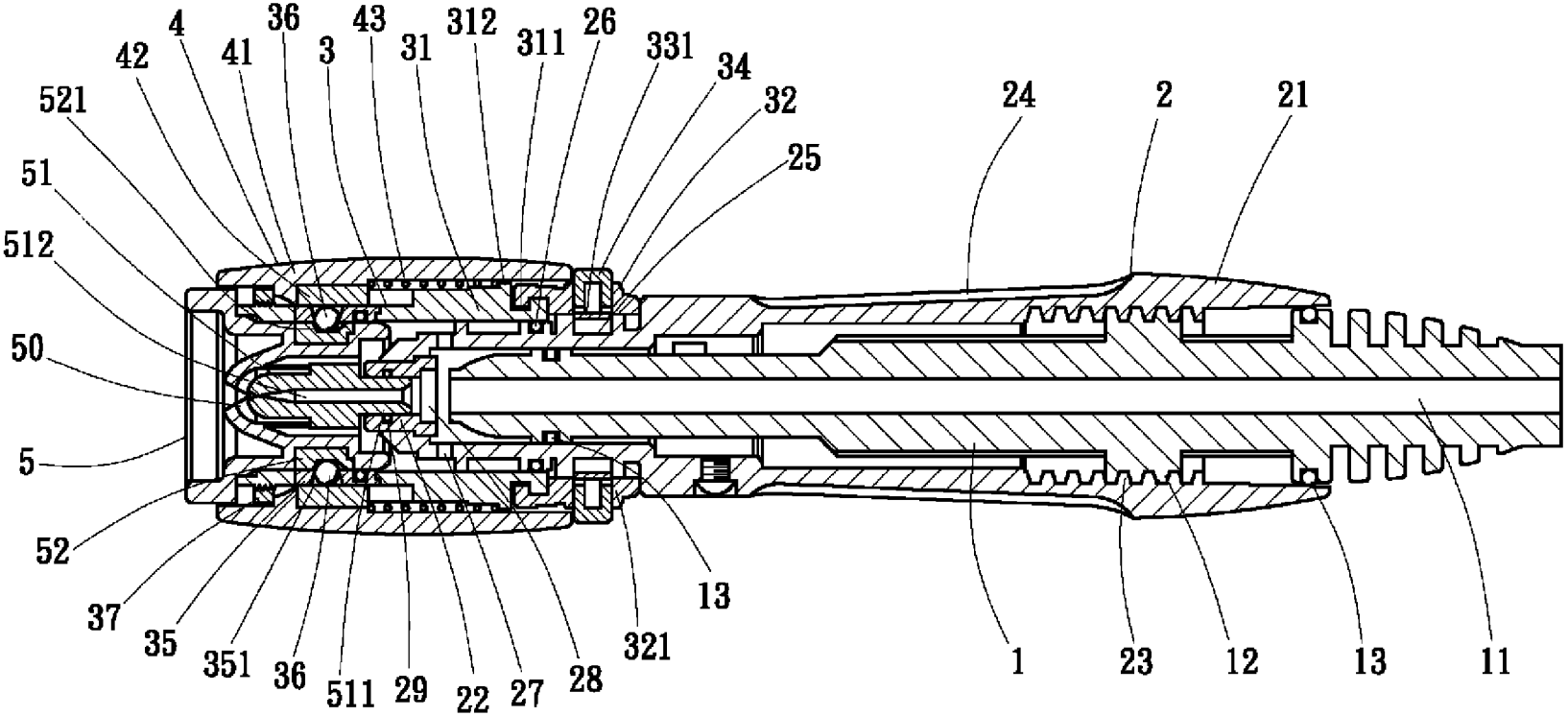
FIG. 3 is a longitudinal sectional view of the pressure-adjustable jet spray nozzle in accordance with the present invention.

The barrel 1, as shown in FIGS. 2 and 3, is a hollow cylindrical member molded from fiber-reinforced plastics attached with a front end piece formed of a metal (copper or aluminum), having a flow passage 11 axially extending through the front and rear ends and outer threads 12 extending around the periphery. Further, two O-rings 13 are respectively mounted on the barrel 1 and located on the front and rear sides relative to the outer threads 12.

The pressure adjuster 2, as shown in FIGS. 2 and 3, comprises an adjustment sleeve 21 and a front ring 22. The adjustment sleeve 21 is molded from fiber-reinforced plastics, having inner threads 23 meshed with the outer threads 12 of the barrel 1, anti-slip grooves 24 arranged around the periphery, a locating groove 25 extending around the periphery for the mounting of an elastic member 33 (this will be described further), an O-ring 26 mounted on the periphery in front of the locating groove 25, and a plurality of radial through holes 27 cut through the periphery in communication with the inside space of the adjustment sleeve 21 in front of the position of the O-ring 26. The front ring 22 is a metal ring (copper or aluminum) affixed to the front end of the adjustment sleeve 21, having a stepped center through hole 28 and an O-ring 29 mounted in the stepped center through hole 28. By means of the stepped center through hole 28, the front ring 22 connects the nozzle head 5 to the front end of the barrel 1.

Figure 4:
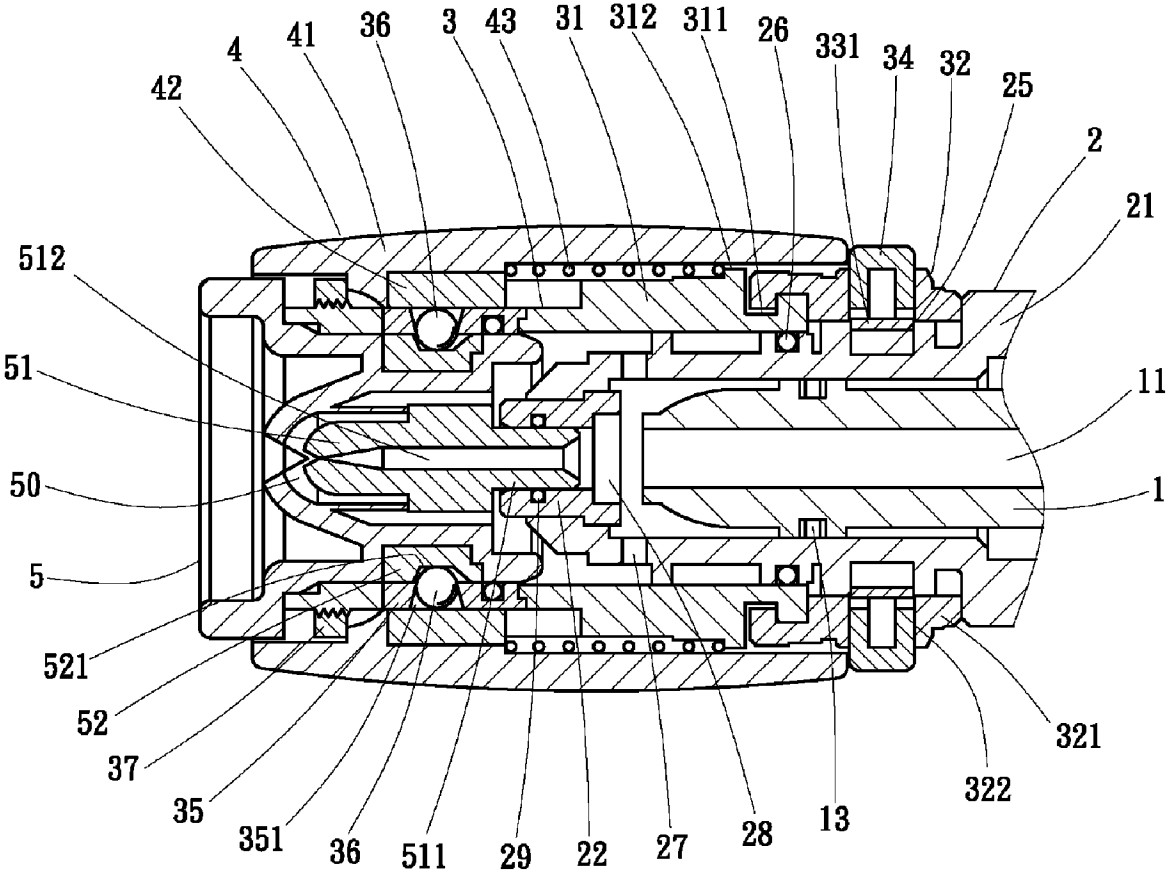
FIG. 4 is an enlarged view of a front part of FIG. 3.
Figure 5:
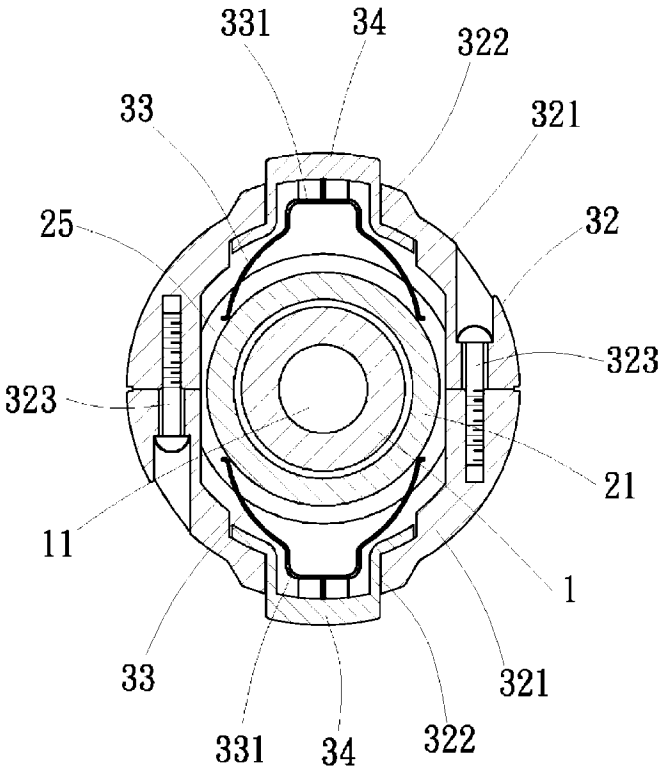
FIG. 5 is a cross sectional view of the pressure-adjustable jet spray nozzle in accordance with the present invention.
Figure 10:
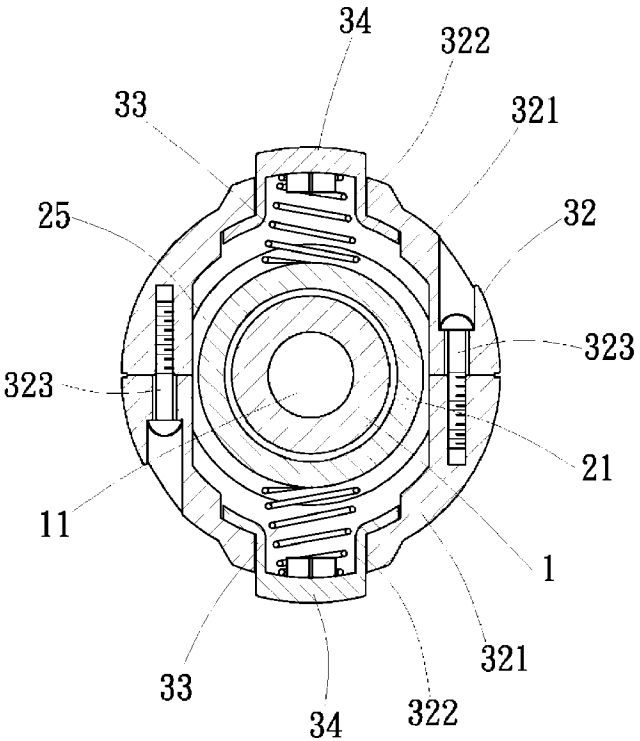
FIG. 10 is a schematic sectional view of the present invention, showing an alternate form of the elastic member.

The support device 3, as shown in FIGS. 2-4, comprises a support ring 31, a connection ring 32, an elastic member 33, two stop blocks 34, a plurality of ball racks 35, a plurality of steel balls 36, and a stop ring 37. The support ring 31 is molded from fiber-reinforced plastics and sleeved onto the front end of the adjustment sleeve 21 of the pressure adjuster 2, having a retaining groove 311 extending around the periphery near the rear end for securing the front end of the connection ring 32 and a bearing flange 312 extending around the periphery in front of the retaining groove 311. The ball racks 35 are embedded in the support ring 31 and equiangularly spaced around the periphery near the front side of the support ring 31. The stop ring 37 is fastened to the front end of the support ring 31. The connection ring 32 is formed of two semicircular ring elements 321. Each semicircular ring element 321 has a mounting through hole 322 for the mounting of one stop block 34. After being attached to the locating groove 25 of the adjustment sleeve 21, the two semicircular ring elements 321 are fastened together with screws 323 and secured to the retaining groove 311 of the support ring 31. The elastic member 33 is formed of two springs (see FIG. 10) or two symmetrical halves (see FIG. 5), having protrusions 331 corresponding to the mounting through holes 322 of two semicircular ring elements 321 of the connection ring 32. The stop blocks 34 are respectively mounted in the mounting through holes 322 of two semicircular ring elements 321 of the connection ring 32 and kept in contact with the protrusions 331 of the elastic member 33 (see FIG. 5). The elastic springy force of the elastic member 33 imparts an outward pressure to the stop blocks 34 so that the stop blocks 34 project out of the mounting through holes 322 to stop the nozzle head lock control device 4 from backward displacement. The ball racks 35 are metal racks fixedly mounted in the support ring 31 and equiangularly spaced around the periphery near the front side of the support ring 31, each having a radial ball hole 351. The steel balls 36 are respectively rotatably mounted in the radial ball holes 351 of the ball racks 35, and peripherally protruding over the inside wall of the support ring 31 for securing the nozzle head 5. The stop ring 37 is fastened to the front end of the support ring 31 to prohibit the nozzle head lock control device 4 from falling out of the support ring 31.

The nozzle head lock control device 4, as shown in FIGS. 2-4, comprises a sliding sleeve 41, a metal insert 42, and a compression spring 43. The sliding sleeve 41 is made of fiber-reinforced plastics and sleeved onto the support ring 31. Further, the sliding sleeve 41 can be moved axially along the support ring 31 between the stop blocks 34 and the stop ring 37. The metal insert 42 is fastened to the inside wall of the sliding sleeve 41, and adapted to push the steel balls 36 out of the inside wall of the support ring 31. The compression spring 43 is sleeved onto the support ring 31 within the sliding sleeve 41 and adapted to impart a forward pressure to the sliding sleeve 41 relative to the support ring 31, causing the metal insert 42 to push the steel balls 36 out of the inside wall of the support ring 31.

The nozzle head 5, as shown in FIGS. 2-4, is made of reinforced plastics and detachably fitted into the front end of the support ring 31. The nozzle head 5 has a center passage 50, and a metal nozzle tip 51 mounted in the center passage 50. The metal nozzle tip 51 has a rear mounting end 511 detachably fitted into the front ring 22 of the pressure adjuster 2. Further, the metal nozzle tip 51 has a center axial hole 512 for receiving clean water or cleaning fluid from the rear end thereof and sending clean water or cleaning fluid out of the front end thereof. The nozzle head 5 further has a positioning ring 52 affixed to the periphery. The positioning ring 52 defines a positioning groove 521 around the periphery for receiving the steel balls 36.

Figure 6:
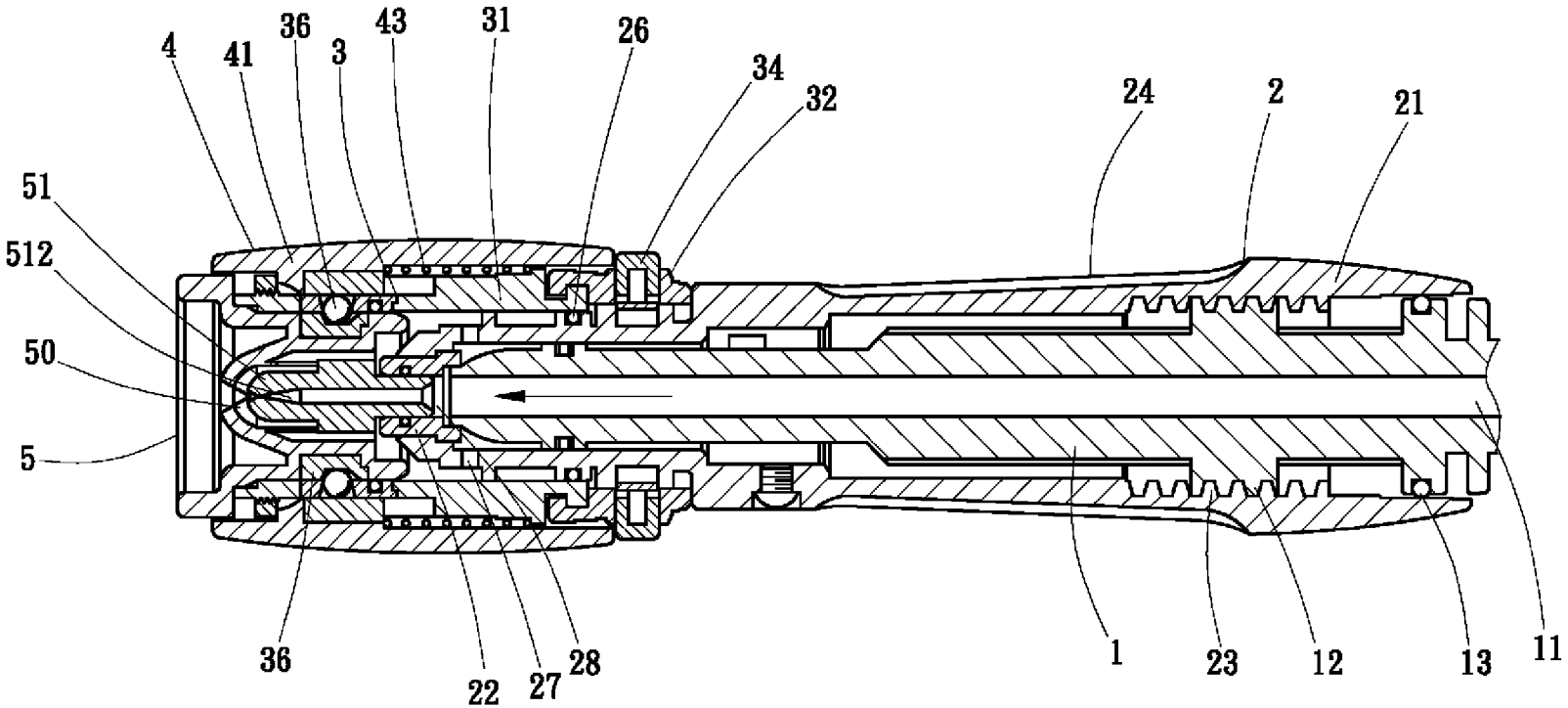
FIG. 6 is a schematic drawing showing a status of use of the pressure-adjustable jet spray nozzle in accordance with the present invention.
Figure 7:
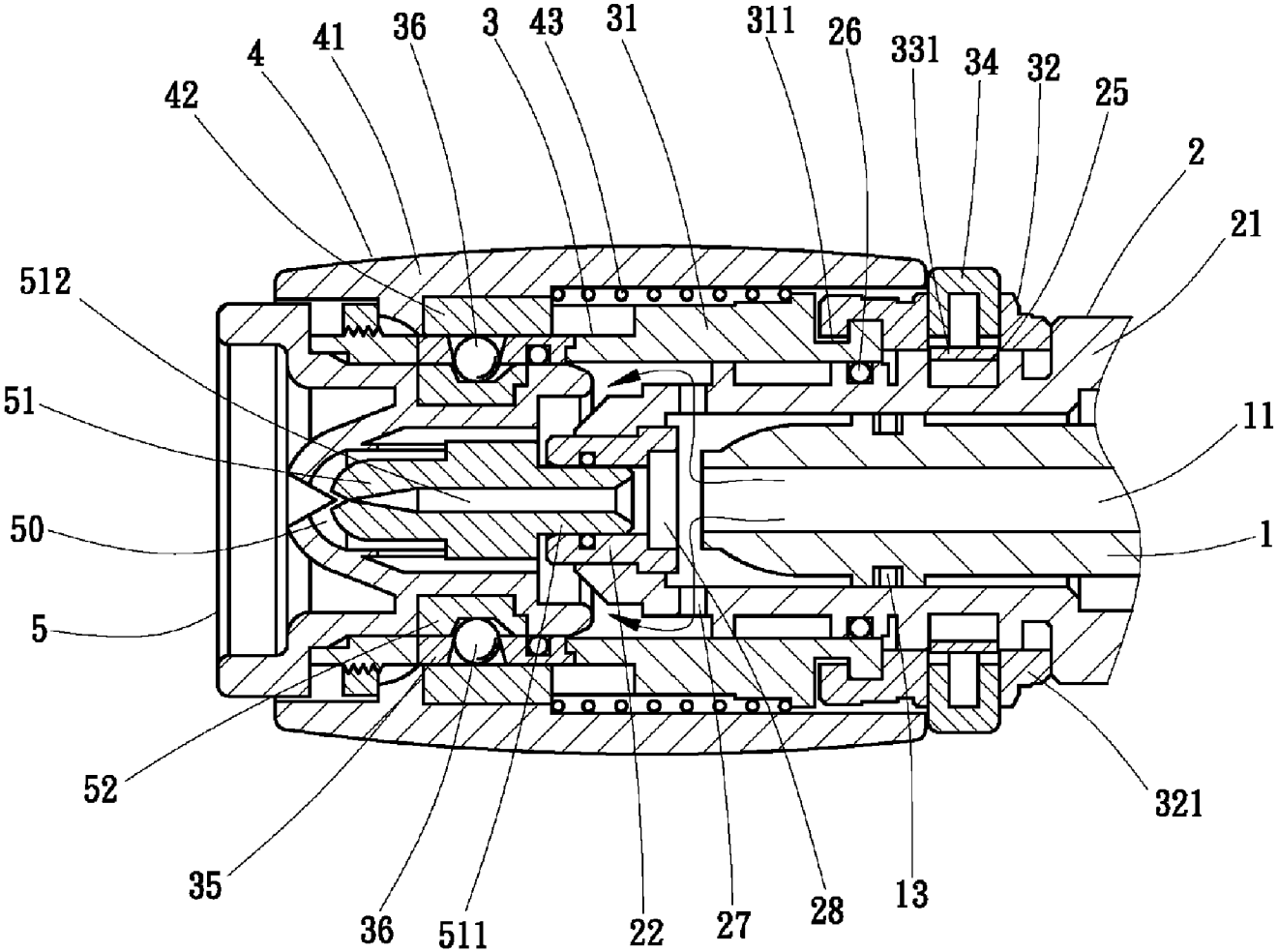
FIG. 7 is a schematic drawing showing another status of use of the pressure-adjustable jet spray nozzle in accordance with the present invention.

The pressure-adjustable jet spray nozzle can be attached to a high-pressure cleaning machine. During application, the user can rotate the adjustment sleeve 21 of the pressure adjuster 2 to move the adjuster 2 forwards or backwards subject to engagement between the inner threads 23 and the outer threads 12, and to further force the barrel 1 into engagement with or away from the front ring 22 of the pressure adjuster 2. As shown in FIG. 6, when the front end of the barrel 1 is engaged into the front ring 22 of the pressure adjuster 2, clean water or cleaning fluid from the high-pressure cleaning machine is delivered through the flow passage 11 of the barrel 1 and the front ring 22 of the pressure adjuster 2 and then forced out of the nozzle tip 51 of the nozzle head 5. Referring to FIG. 7, when the barrel 1 is disengaged from the front ring 22 of the pressure adjuster 2, clean water or cleaning fluid from the high-pressure cleaning machine is delivered through the radial through holes 27 of the adjustment sleeve 21 and then forced out of the center passage 50 and the nozzle tip 51 of the nozzle head 5 at a relatively lower pressure. Thus, the user can adjust the output pressure of the pressure-adjustable jet spray nozzle.

Figure 8:
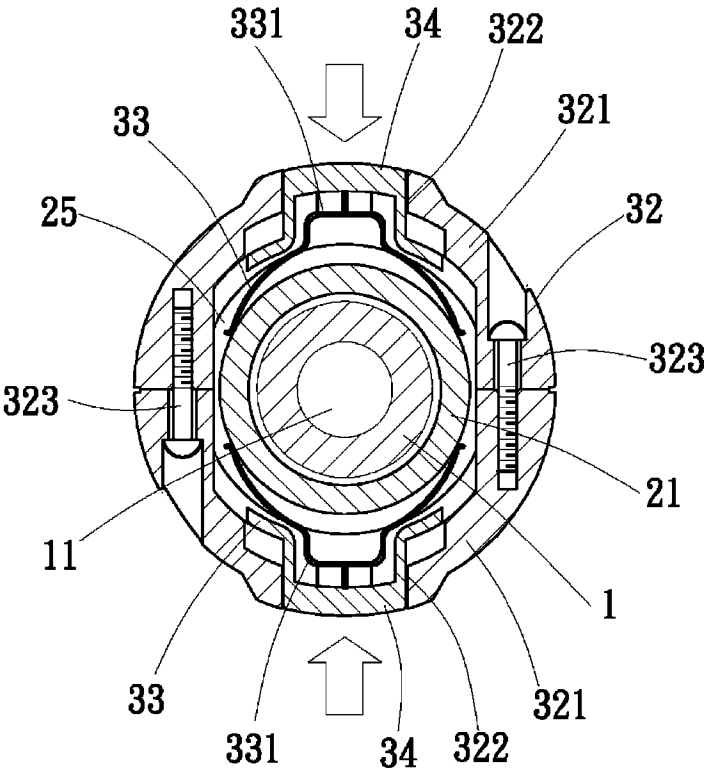
FIG. 8 is a schematic drawing showing still another status of use of the pressure-adjustable jet spray nozzle in accordance with the present invention.
Figure 9:
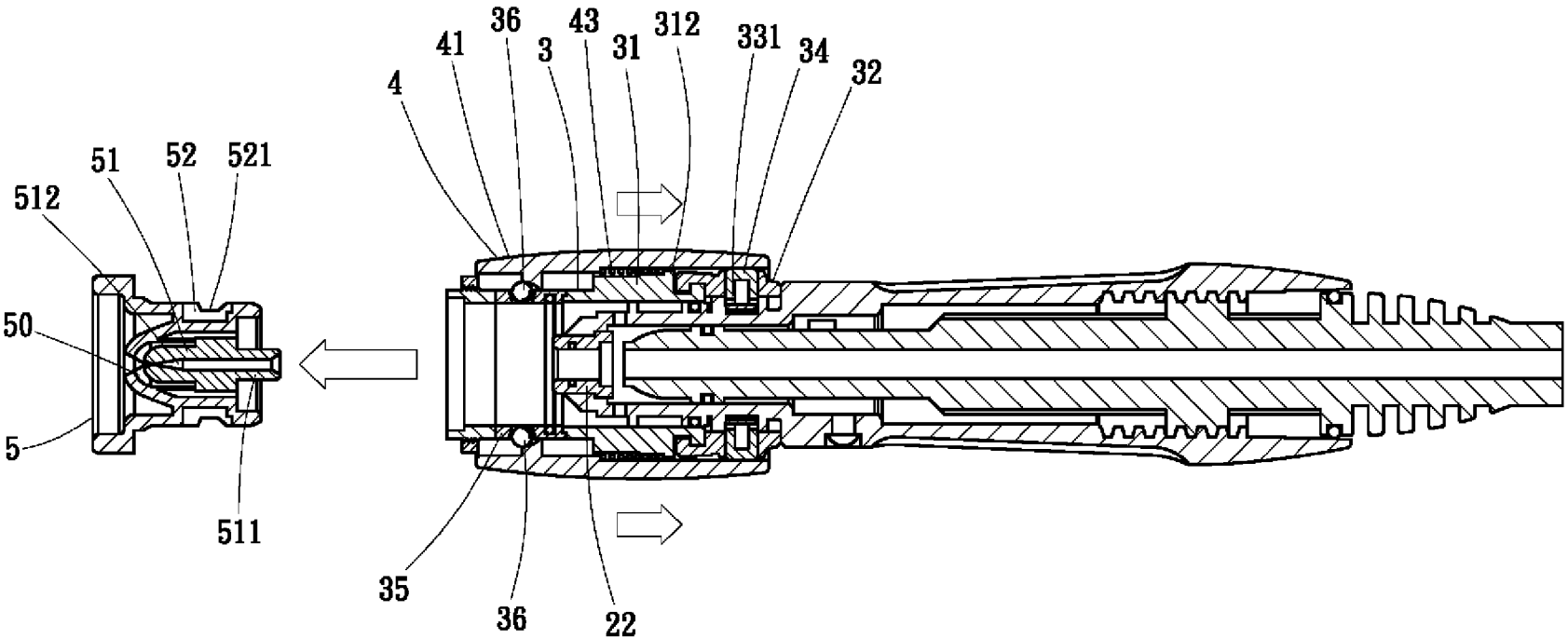
FIG. 9 is a schematic drawing showing still another status of use of the pressure-adjustable jet spray nozzle in accordance with the present invention.

Referring to FIG. 8, the nozzle head 5 can be conveniently detached from the pressure-adjustable jet spray nozzle for a replacement. When the stop blocks 34 of the support device 3 are pressed, as shown in FIG. 9, the sliding sleeve 41 of the nozzle head lock control device 4 is unlocked and can be moved backwards relative to the support ring 31 to release the steel balls 36 from the constraint of the metal insert 42, allowing the nozzle head 5 to be removed from the support ring 31. When a new nozzle head 5 is attached to the front end of the support ring 31, the compression spring 43 of the nozzle head lock control device 4 immediately pushes the sliding sleeve 41 forward to force the steel balls 36 into the positioning groove 521 of the positioning ring 52 of the nozzle head 5, thereby locking the new nozzle head 5 to the support ring 31.

Further, the pressure adjuster 2 and the nozzle head lock control device 4 are connected together by the two semicircular ring elements 321 of the connection ring 32. When the user rotates the nozzle head lock control device 4 with the hand, the nozzle head 5 is rotated with the nozzle head lock control device 4 and the support device 3 to the desired angle. At this time, the pressure adjuster 2 and the barrel 1 are immovable. Therefore, during a high-pressure water spraying operation, the user can rotate the nozzle head 5 to the desired angle freely with less effort, improving working efficiency and avoiding fatigue on job.

A prototype of pressure-adjustable jet spray nozzle has been constructed with the features of FIGS. 1-9. The pressure-adjustable jet spray nozzle functions smoothly to provide all of the features disclosed above.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A pressure-adjustable jet spray nozzle, comprising:

a barrel defining a flow passage through front and rear ends thereof;

a pressure adjuster, said pressure adjuster comprising an adjustment sleeve sleeved onto said barrel and a front ring affixed to a front end of said adjustment sleeve, said adjustment sleeve having a locating groove extending around the periphery near the front end thereof, said front ring defining a center through hole;

a support device, said support device comprising a support ring sleeved onto the front end of said adjustment sleeve, a plurality of ball racks fixedly mounted in said support ring and equiangularly spaced around the periphery of said support ring, each said ball rack having a ball hole, a connection ring surrounding the locating groove of said adjustment sleeve, said connection ring having at least one mounting through hole, an elastic member mounted in the locating groove of said adjustment sleeve, at least one stop block respectively mounted in the at least one mounting through hole of said connection ring and having a bottom side thereof kept in contact with said elastic member which imparts an outward pressure to said at least one stop block, a plurality of steel balls respectively rotatably mounted in the ball holes of said ball racks, and a stop ring fastened to a front end of said support ring;

a nozzle head lock control device, said nozzle head lock control device comprising a sliding sleeve sleeved onto said support ring and axially movable between said at least one stop block and said stop ring for forcing said steel balls out of the inside wall of said support ring, and a compression spring sleeved onto said support ring within said sliding sleeve and adapted to impart a forward pressure to said sliding sleeve relative to said support ring; and a nozzle head insertable into said support ring, said nozzle head having a positioning ring fastened to the periphery thereof, said positioning ring having a positioning groove extending around the periphery thereof for receiving said steel balls to lock said nozzle head to said support ring.

2. The pressure-adjustable jet spray nozzle as claimed in claim 1, wherein said barrel has outer threads extending around the periphery thereof, and O-rings respectively fastened to the periphery thereof at front and rear sides relative to said outer threads; and said adjustment sleeve has inner threads threaded onto the outer threads of said barrel, an O-ring mounted on the periphery thereof in front of said locating groove, and a plurality of radial through holes cut through the periphery in communication with the inside space of said adjustment sleeve.

3. The pressure-adjustable jet spray nozzle as claimed in claim 1, wherein said front ring of the pressure adjuster has an O-ring mounted in the center through hole thereof and is connectable between the front end of said barrel and a rear end of said nozzle head.

4. The pressure-adjustable jet spray nozzle as claimed in claim 1, wherein said support ring has a retaining groove extending around the periphery near a rear end thereof for fastening to a front end of said connection ring and a bearing flange extending around the periphery in front of said retaining groove for stopping against said compression spring; and said connection ring is formed of two semicircular ring elements fastened together and attached to the locating groove of said adjustment sleeve and secured to the retaining groove of said support ring, each said semicircular ring element having one mounting through hole for the mounting of one respective stop block.

5. The pressure-adjustable jet spray nozzle as claimed in claim 1, wherein said elastic member of said support device has at least one protrusion corresponding to the at least one mounting through hole of said connection ring for pushing said at least one stop block outwards relative to said at least one mounting through hole of said connection ring.

6. The pressure-adjustable jet spray nozzle as claimed in claim 1, wherein said nozzle head lock control device comprises a metal insert mounted inside said sliding sleeve and adapted to push said steel balls out of the inside wall of said support ring.

7. The pressure-adjustable jet spray nozzle as claimed in claim 1, wherein said nozzle head has a center passage, and a metal nozzle tip mounted in the center passage, said metal nozzle tip having a rear mounting end detachably fitted into the front ring of said pressure adjuster, said metal nozzle tip having a center axial hole extending through front and rear ends thereof.

* * * * *